United States Patent [19]

Littwin

[11] 4,338,539

[45] Jul. 6, 1982

[54] GAS DISPLAY DEVICE WITH A PROFILED CATHODE

[75] Inventor: Burkhard Littwin, Hohenschaeftlarn, Fed. Rep. of Germany

[73] Assignee: Siemens Aktiengesellschaft, Berlin & Munich, Fed. Rep. of Germany

[21] Appl. No.: 136,422

[22] Filed: Apr. 2, 1980

[30] Foreign Application Priority Data

Apr. 23, 1979 [DE] Fed. Rep. of Germany ..... 2916368

[51] Int. Cl.[3] ..... H01J 17/04

[52] U.S. Cl. ..... 313/217

[58] Field of Search ..... 313/217, 188; 315/169.3, 169.4

[56] References Cited

U.S. PATENT DOCUMENTS 3,767,968 10/1973 Ogle ..... 313/188

3,956,667 5/1976 Veith .

3,992,644 11/1976 Chodil et al. ..... 313/217

4,130,778 12/1978 Branston .

*Primary Examiner*—Bruce C. Anderson

*Attorney, Agent, or Firm*—Hill, Van Santen, Steadman, Chiara & Simpson

[57] ABSTRACT

A gas discharge display device has a hermetically sealed gas filled envelope having an anode plate on one interior side and a profiled cathode on an opposite interior side. A control plate having a conductor matrix thereon formed of row conductor runs on one side and column conductor runs on an opposite side with perforations in the plate disposed at row-column intersections is disposed inside the envelope parallel to the anode and cathode and divides the interior of the envelope into a post-acceleration area near the anode and a discharge area near the cathode. The cathode profile is a plurality of spaced ribs disposed parallel to at least one set of conductor runs on the control plate. Upon cathode energization, gas electrons are ionized on that part of the cathode confined by neighboring ribs and opposite to air charged conductor on the control plate and subsequently drawn to the anode plate through the matric holes to display a point-form image. By confining the gas discharge to the vicinity of a small number of conductor rows, unwanted background luminosity is substantially minimized on the display screen.

17 Claims, 10 Drawing Figures

GAS DISPLAY DEVICE WITH A PROFILED CATHODE

BACKGROUND OF THE INVENTION

1. Field of the Invention

The present invention relates to gas discharge display devices, and in particular to an improvement in such devices having a control plate with a conductor matrix thereon.

2. Description of the Prior Art

A gas discharge display device having a control plate disposed in the gas envelope between the anode and cathode is known from German OS No. 2,412,869, corresponding to U.S. Pat. No. 3,956,667. The control plate in that device divides the interior of the gas envelope into two chambers which are interconnected by perforations in the control plate. The control plate has rows of conductor runs on one side thereof and columns of conductor runs on an opposite side, with the perforations being disposed at row-column intersections. The conductor runs are positively charged and serve as auxiliary anodes. Gas discharge takes place in the chamber between the cathode and the side of the control plate having conductor rows, while post-acceleration of the ions takes place in the chamber between the side of the control plate having conductor columns and the anode. A luminescent screen is carried on the anode. By energizing one or more of the auxiliary anodes, a wedge-shaped gas discharge volume of plasma is formed between the cathode and the auxiliary anode over the entire conductor row length. By simultaneous activation of one or more of the matrix conductor columns on the opposite side of the control plate, plasma electrons generated in the gas discharge area are drawn through the perforations at the intersection points of the rows and columns into the post-acceleration area and accelerated to the anode. Upon impact at the anode luminescent screen, which may be disposed before the anode, a light point is generated as the image of the activated intersection point of the matrix. By selected matrix activation according to time-varying sequence and intensity, characters and images can be displayed on the luminescent screen.

In order to improve and insure that a wedge-shaped gas discharge will be generated under all operating conditions, it is known from German OS No. 2,643,915, corresponding to U.S. Pat. No. 4,130,778 to divide the plate cathode of the above-discussed device into sub-cathodes in the form of cathode strips disposed parallel to the auxiliary anodes. A group of auxiliary anodes is then associated with each sub-cathode. By energization of the sub-cathodes and simultaneous or sequential energization of the corresponding auxiliary anode group, a wedge-shaped gas discharge area is generated only between the anodes and a specific sub-cathode. The division of the cathode plate and the number of auxiliary anodes associated with each sub-cathode is dependent upon the intended use and operating parameters of the display device, such as the type of gas utilized and the gas pressure in the envelope.

Even with the improvement of U.S. Pat. No. 4,130,778, a problem still exists in eliminating or minimizing background luminosity. Such background luminosity results from the fact that even with the use of sub-cathodes the gas discharge area is not sufficiently narrow to encompass only a single conductor row which has been activated so that some ions are still drawn through matrix perforations in non-energized conductor rows, which are then accelerated by the anode attraction and may blur the image on the luminescent screen.

SUMMARY OF THE INVENTION

It is an object of the present invention to provide a gas discharge display device of the type having a matrix control plate disposed in the gas envelope with a means for restricting the gas discharge in the space between the control plate and the cathode to a region sufficiently narrow to encompass only a single conductor row. By so doing, the ultimate object of decreasing background luminosity and thereby improving the resolution of the displayed image is achieved.

The above objects are inventively achieved in a gas discharge display device of the type initially described in which the plate cathode exhibits a profile when viewed in cross section having a plurality of spaced ribs extending in a direction toward the control plate so that those portions of the cathode comprising the ribs are disposed a shorter distance from the control plate, while the portions of the cathode between the ribs are disposed a greater distance from the control plate. The distance between the cathode and the control plate when plotted as a function of increasing distance in the cathode plane will be a periodic function. As a result of principles well known to those skilled in the art. The gas discharge will be confined to that part of the cathode opposite to an activated conductor row and constricted by two neighbouring, ribs. By aligning the ribs with groups of auxiliary anodes, the passing of ions through matrix perforations in non-energized auxiliary anode rows is substantially minimized.

In one embodiment of the invention, the cathode of the gas discharge display device is a plate having a plurality of rectangular ribs perpendicularly disposed in parallel fashion thereon. A corresponding number of flat plane surfaces is thereby formed between successive ribs. The cathode is disposed with respect to the control plate so that at least a portion of the ribs are in parallel alignment with the conductor runs on the control plate forming the auxiliary anode paths. The interval between the ribs of the cathode and the corresponding electrode path of the control plate is selected so that gas discharge occurring as a result of energization of the cathode is restricted to the area immediately surrounding the corresponding group of auxiliary anodes. The interval is further selected to prevent unwanted spreading or diffusion of ions over the entire surface of the cathode during energization of an auxiliary anode row, so that selected step-wise advancement of the gas discharge line by sequential energization of successive auxiliary anode rows on the control plate can still be undertaken.

In another embodiment of the invention, the distance of the cathode ribs to the corresponding auxiliary anode paths on the control plate is selected so that a rib is in each instance disposed opposite the location on the control plate where two successive groups of anode paths join, so that the distance between adjacent cathode ribs corresponds approximately to the width of half of a group of the auxiliary anode paths.

In another embodiment of the invention, a plurality of strip sub-cathodes arranged in parallel fashion are substituted for the plate cathode. Each sub-cathode has ribs extending perpendicularly from the edges of the strip, and the sub-cathodes are insulated from each other and may be energized simultaneously or sequentially by means of circuitry known in the art which is not a part of this invention.

The cathode in all embodiments preferably consists of metal or of a metal alloy and is coated with a surface layer or film, such as an aluminium layer. To improve thermal radiation, it is advantageous to coat the cathode with a black coating on the side of the cathode facing away from the gas discharge chamber.

The cathode may further have arranged on the surface facing the control plate a plurality of support profiles or ribs comprised partially or entirely of electrically non-conductive material and which support the control plate a fixed distance from the electrically conductive portions of the cathode.

DESCRIPTION OF THE PREFERRED EMBODIMENTS

Figure 1:
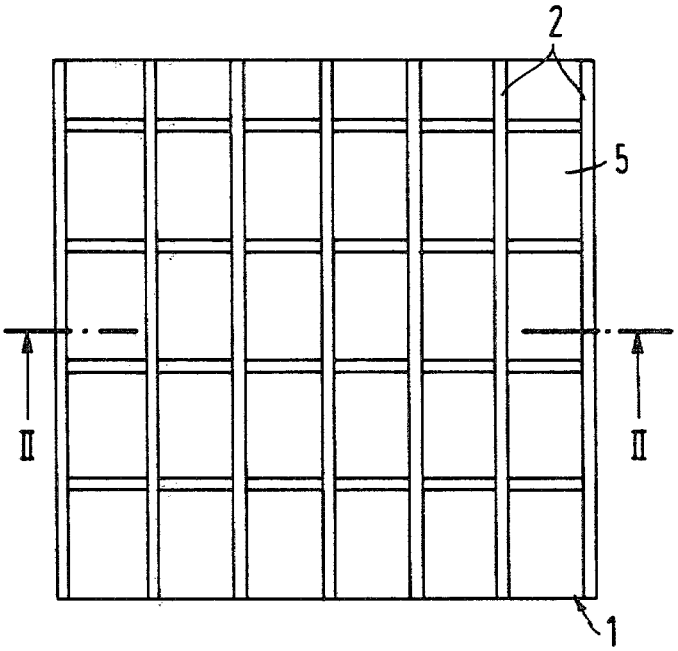
FIG. 1 is a plan elevational view of a profiled cathode constructed in accordance with the principles of the present invention.
Figure 2:
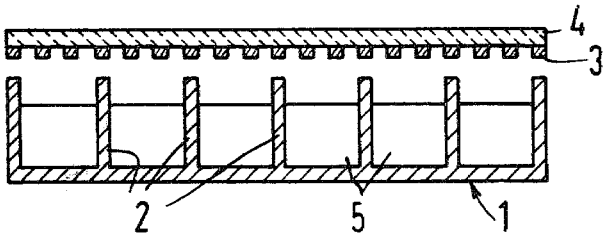
FIG. 2 is a sectional view taken along line II—II of FIG. 1, with the addition of a sectional view of the control plate above the cathode.

A profiled cathode referenced generally at 1 is shown in plan view in FIG. 1 and in sectional view in FIG. 2 with the addition of a control plate 4 having rows 3 of conductor runs thereon which form auxiliary anodes. The cathode and control plate are for use in a gas discharge display device and are connected to respective power supplies which are not shown. The control plate 4 also has columns of conductor runs thereon on a side opposite to the side carrying the rows 3 and a plurality of perforations disposed at intersections of the rows and columns. The columns and holes are not shown in FIG. 2.

The cathode 1 carries a plurality of upward protrusions thereon in the form of rectangular ribs 2 extending perpendicularly from the cathode 1. The ribs 2 are arranged in parallel fashion and define a flat surface 5 between adjacent ribs.

Figure 3:
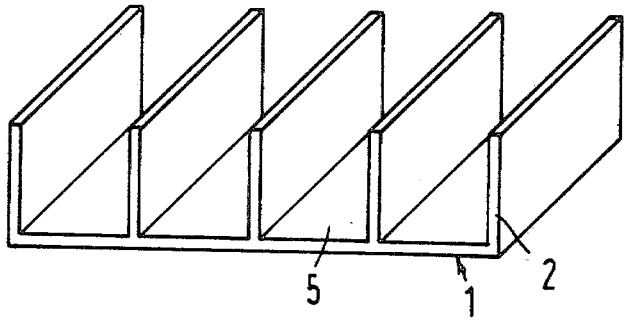
FIG. 3 is a perspective view of the profiled cathode of FIG. 1.

The cathode of FIGS. 1 and 2 is shown in perspective view in FIG. 3.

Figure 4:
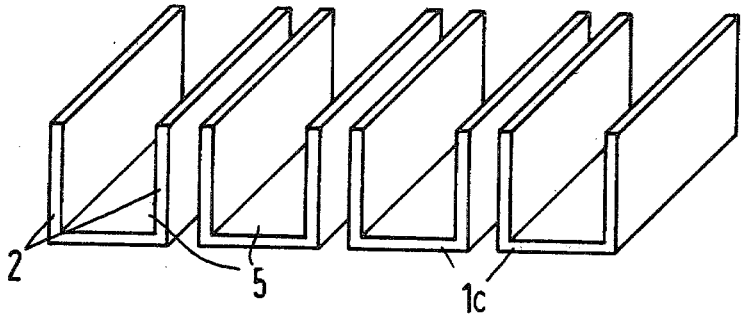
FIG. 4 is a perspective view of an embodiment of the profiled cathode using sub-cathodes.

Another embodiment of the cathode is shown in FIG. 4 comprised of separate cathode strips 1*c* which form subcathodes and which are arranged in parallel fashion. Each cathode strip 1*c* has a pair of parallel ribs 2 extending from the edges thereof. Each cathode strip 1*c* is connected to a power source and may be simultaneously or sequentially energized.

Figure 5:
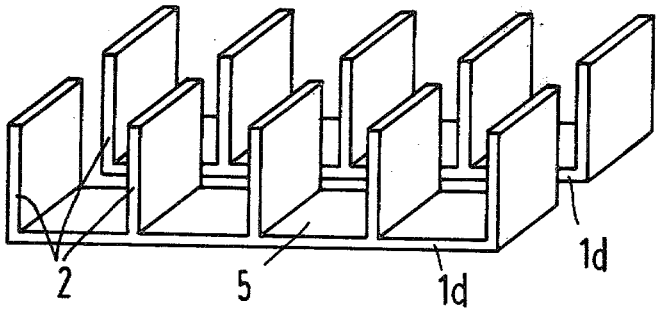
FIG. 5 is a perspective view of an embodiment of the profiled cathode utilizing sub-cathodes divided perpendicularly to the profiles.

A further embodiment of the profiled cathode is shown in perspective view in FIG. 5 in which the cathode of FIG. 3 is divided into cathode strips 1*d* which form sub-cathodes. The division is made along lines perpendicular to the ribs 2.

Figure 6:
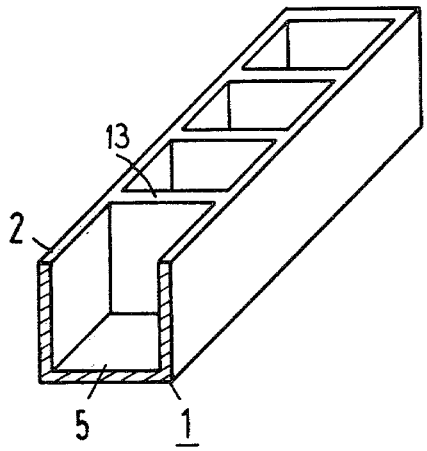
FIG. 6 is a perspective view, partly in section, of a portion of a profiled cathode having perpendicular ribs.

Another arrangement of the profiled cathode is shown in FIG. 6 in which a portion of the cathode 1 is shown in perspective view with the addition of a plurality of ribs 13 disposed orthogonally with respect to the cathode 1 and the ribs 2. The addition of the transverse ribs 13 increases the active area of the cathode 1 at which gas discharge is facilitated.

Figure 7:
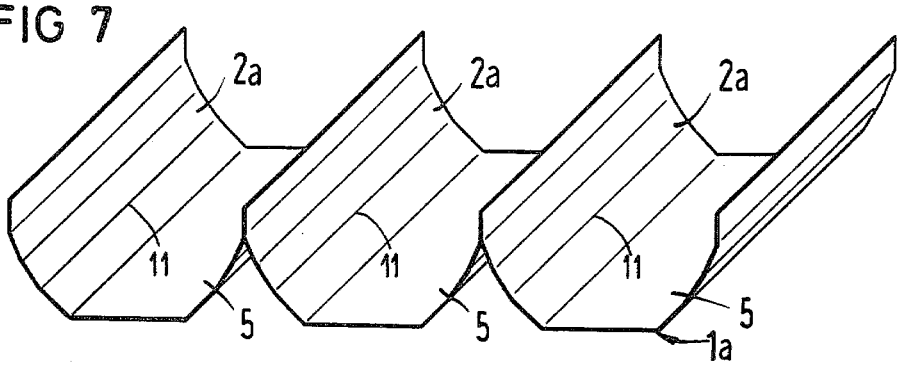
FIG. 7 is a perspective view of a portion of a profiled cathode having curved ribs.

An embodiment of the profiled cathode is shown in FIG. 7 which may advantageously be formed of a sheet metal cathode 1*a*. A plurality of parallel projections 2*a* are formed by bending the cathode 1*a* along parallel seams 11. The projections 2*a* thus exhibit a generally curved profile and again define plane areas 5 between adjacent projections.

Figure 8:
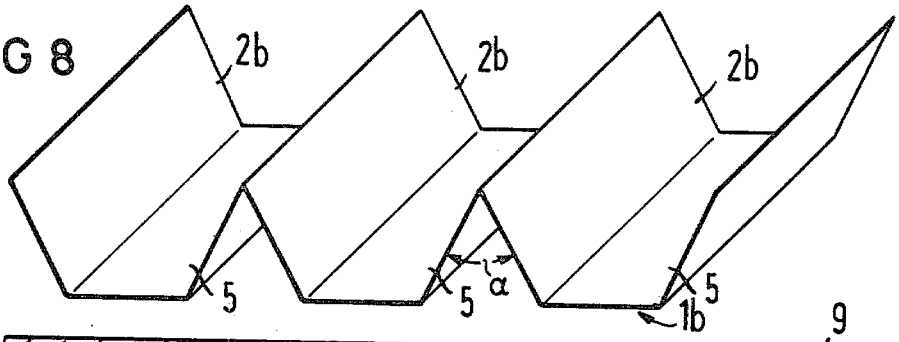
FIG. 8 is a perspective view of a portion of a profiled cathode having inclined ribs.

A further embodiment which may be formed out of a sheet metal cathode 1*b* is shown in FIG. 8 in which the projections 2*b* are inclined. The angle $\alpha$ is between 0° and 90° and may be varied according to operating conditions and requirements. For most applications, an angle $\alpha$ of 52° is suitable.

Figure 9:
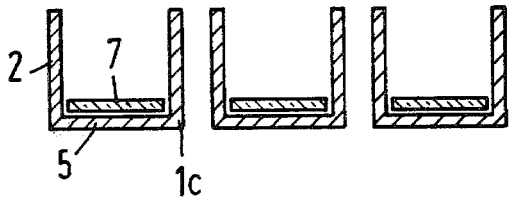
FIG. 9 is a sectional view of the embodiment of FIG. 4 utilizing an insulating layer to cover areas of the cathode between the ribs.

An embodiment is shown in FIG. 9 of the strip cathode arrangement shown in FIG. 4 in which the areas 5 between adjacent ribs 2 are covered with an insulating layer 7. This further prevents ionization from taking place in the area immediately surrounding the plane area 5, so that the fast electrons of the gas discharge cannot move straight or to the not shown conductor rows. It will be understood that insulating layers 7 may be applied to the plane areas 5 shown in any of the other embodiments as well. The insulating layer 7 may consist, for example, of glass.

Figure 10:
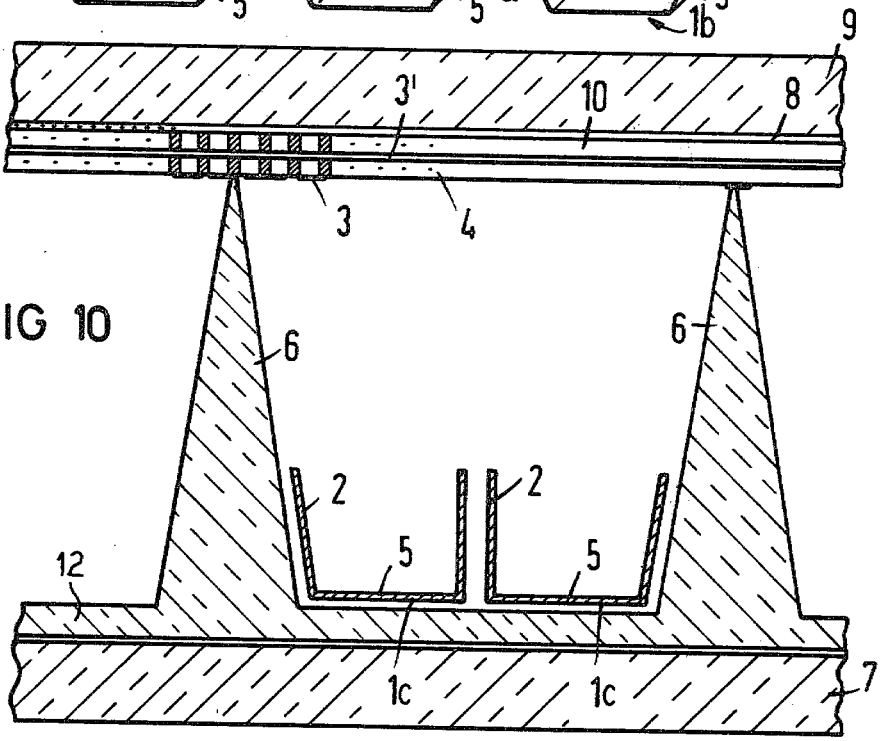
FIG. 10 is a sectional view of an assembled gas discharge device utilizing a profiled cathode and insulating control plate support profiles.

A gas discharge display device embodying the profiled cathode shown in FIG. 4 is illustrated in cross section in FIG. 10. The cathode strips 1*c* are disposed between supporting profiles 6 which extend a substantially greater height than do the ribs 2. The profiles 6 are integrally formed on a plate 12 and consist entirely or partially of electrically non-conductive material. If the profiles 6 consist only partially of non-conductive material, the non-conductive portion is disposed at a top of each profile. This arrangement is particularly well suited for use with the strip cathodes 1*c*, however, it will be apparent to those skilled in the art that insulating supporting profiles may be employed with any of the embodiments disclosed herein and need not necessarily be a separately formed component.

The gas discharge device of FIG. 10 is sealed on one side by a rear plate 7 and on the opposite side by a front plate 9 to form a hermetically sealed gas envelope therebetween. A luminescent screen 8 is disposed between the front plate 9 and a spacer plate 10 with the control plate 4 having rows 3 and columns 3' thereon being supported by the profiles 6.

Although dimensions may be selectively varied according to operating conditions and requirements, such as the type of gas utilized and the gas pressure within the envelope, a suggested range for the distance between adjacent ribs is approximately 25 mm, and the tops of the cathode projections may terminate approximately 15 mm from the control plate 4. A gas discharge display device having dimensions of approximately 1,000 mm by 1,200 mm is ideally suited for the display of television pictures.

Although modifications and changes may be suggested by those skilled in the art, it is the intention of the inventor to embody within the patent warranted hereon all changes and modifications as reasonably and properly come within the scope of his contribution to the art.

I claim as my invention:

1. In a gas discharge display device having a hermetically sealed gas filled envelope with parallel front and rear plates, a perforated control plate disposed in said envelope between and parallel to said front and rear plates carrying parallel conductor rows on a side nearest said rear plate and parallel conductor columns on a side nearest said front plate, said columns and rows forming a perpendicular matrix and intersecting at said perforations, said front plate carrying an anode layer and a luminescent screen, the improvement of:

a cathode plate carried on said rear plate having a plurality of spaced raised parallel projections extending in the direction of said control plate, at least some of said projections being aligned with said rows on said control plate and terminating a distance therefrom forming a periodically varying control plate-to-cathode profile, the spacing between said projections and said distance between said projections and said control plate being selected for generating localized discrete areas of gas discharge surrounding said projections upon energization of said cathode plate such that substantially no spreading of said gas discharge occurs through said control plate in order to avoid blurring of an image on the luminescent screen.

2. The improvement of claim 1 wherein said projections are rectangular ribs disposed perpendicularly to said cathode plate and arranged in parallel fashion thereon at equal intervals.

3. The improvement of claim 1 wherein said projections are disposed in parallel fashion on said control plate and are formed by mutually curved surfaces which intersect at a line which is a distance from said control plate to form an area between adjacent projections having a widest dimension nearest said control plate and a narrowest dimension at said cathode plate.

4. The improvement of claim 1 wherein said projections are formed by two mutually inclined plane surfaces which intersect at a line a distance from said control plate and form an angle between 0° and 90°.

5. The improvement of claim 1 wherein said angle is 52°.

6. The improvement of claim 1 wherein said rows on said control plate are divided into successive groups of rows and wherein said projections are disposed on said cathode plate opposite the boundary between successive groups of rows and opposite a midpoint between successive boundaries, whereby the distance between two adjacent projections on the cathode plate is approximately ½ of the width of a group of control plate rows.

7. The improvement of claim 1 wherein a plurality of strip cathodes are carried in parallel fashion on said rear plate, each strip cathode having a pair of parallel projections extending perpendicularly from the edges thereof, and each cathode strip being insulated from other cathode strips and connected to circuitry for simultaneous and sequential energization thereof.

8. The improvement of claim 1 wherein said projections are rectangular ribs extending perpendicularly from said cathode plate in parallel perpendicularly intersecting rows and columns.

9. The improvement of claim 1 wherein said projections are rectangular ribs perpendicularly disposed on said cathode plate, and wherein said cathode plate is divided into a plurality of strip cathodes along parallel lines perpendicular to said ribs.

10. The improvement of claim 1 wherein the cathode plate consists of a metal.

11. The improvement of claim 1 wherein said cathode plate is coated with a metal surface layer.

12. The improvement of claim 13 wherein said metal is aluminium.

13. The improvement of claim 1 wherein the side of said cathode plate facing away from said control plate is coated with a thermal radiation absorbing coating.

14. The improvement of claim 1 wherein said cathode carries additional projections thereon comprised at least partially of electrically non-conductive material which extend to and support said control plate a fixed distance from said cathode plate.

15. The improvement of claim 1 wherein areas of said cathode plate between adjacent projections are covered with an insulating layer for preventing ionization of said gas between said projections.

16. The improvement of claim 1 wherein the spacing between adjacent projections is approximately 25 millimeters.

17. The improvement of claim 1 wherein said projections terminate approximately 15 millimeters from said control plate.

* * * * *